US005839026A

United States Patent [19]

Ko

[11] Patent Number: 5,839,026

[45] Date of Patent: Nov. 17, 1998

[54] METHOD OF CONTROLLING CHARGE VOLTAGE OF IMAGE FORMING APPARATUS USING ELECTROPHOTOGRAPHIC DEVELOPING PROCESS

[75] Inventor: Chang-Kyung Ko, Suwon, Rep. of Korea

[73] Assignee: SamSung Electronics Co., Ltd., Suwon, Rep. of Korea

[21] Appl. No.: 819,319

[22] Filed: Mar. 18, 1997

[30] Foreign Application Priority Data

Mar. 18, 1996 [KR] Rep. of Korea ..... 1996/7215

[51] Int. Cl.[6] ..... G03G 15/02

[52] U.S. Cl. ..... 399/100; 399/174

[58] Field of Search ..... 399/50, 174, 175, 399/176, 99, 98, 100; 361/225

[56] References Cited

U.S. PATENT DOCUMENTS 5,164,779 11/1992 Araya et al. .
5,247,328 9/1993 Daunton et al. .
5,479,243 12/1995 Kurokawa et al. .
5,506,669 4/1996 Inoue et al. .
5,517,289 5/1996 Ito et al. .
5,541,717 7/1996 Saito et al. .
5,557,373 9/1996 Miyashita et al. .
5,557,375 9/1996 Nagayasu et al. .
5,559,593 9/1996 Yoshinaga et al. .

*Primary Examiner*—Arthur T. Grimley
*Assistant Examiner*—Quana Grainger
*Attorney, Agent, or Firm*—Robert E. Bushnell, Esq.

[57] ABSTRACT

A method of controlling a charge voltage of an image forming apparatus using an electrophotographic developing process so as to enhance cleaning efficiency by increasing the number of collecting positively-charged toner adhering to contact charging unit. The method includes: applying a charge voltage of a predetermined voltage level to a contact charging unit to uniformly charge an outer surface of a photoconductive body to a predetermined polarity while a main motor rotates; when cleaning the contact charging unit, applying a charge voltage exhibiting a voltage level lower than the predetermined voltage level to the contact charging unit to create a potential difference between the contact charging unit the photoconductive body; and transferring charged toner particles adhered to the contact charging unit, to the photoconductive body by shutting off the charge voltage being applied to the contact charging unit.

18 Claims, 5 Drawing Sheets

*Background Art*

METHOD OF CONTROLLING CHARGE VOLTAGE OF IMAGE FORMING APPARATUS USING ELECTROPHOTOGRAPHIC DEVELOPING PROCESS

CLAIM FOR PRIORITY

This application makes reference to, incorporates the same herein, and claims all benefits accruing under 35 U.S.C. §119 from an application for *Method Of Controlling Charge Voltage Of Apparatus Using Electrophotographic Developing Process* earlier filed in the Korean Industrial Property Office on 18 Mar. 1996 and there duly assigned Ser. No. 7215/1996.

BACKGROUND OF THE INVENTION

1. Field of the Invention

The present invention generally relates to an image forming apparatus using an electrophotographic developing process such as a laser beam printer, copier and facsimile machine, and more particularly, relates to a method of controlling charge voltages of such an image forming apparatus for cleaning negative polarity toner adhered to the outer surface of a contact-type charge roller.

2. Description of the Related Art

Electrophotographic developing process is widely used in computer printers, facsimile machines and photocopiers in order to produce images on recording media in response to video signals. A common example of an electrophotographic printing apparatus is a laser beam printer which prints images on individual sheet of paper through a series of electrostatic image-forming steps. Generally, the process of electrostatic image forming includes charging a photosensitive drum to a substantially uniform potential so as to sensitize the surface thereof The charged portion of the photosensitive drum is exposed to a light image of an original document being reproduced. This creates an electrostatic latent image corresponding to the document image on the photosensitive drum. After the electrostatic latent image is formed on the photosensitive drum, the latent image is developed by applying toner from a developing unit into contact with the latent image formed on the photosensitive drum. This forms a toner image of the original document on the photosensitive drum which is subsequently transferred and fixed on a recording medium. When a toner image is fixed on a recording medium, the toner image is first heated and fused onto the recording medium, and then naturally cooled so that it is fixed onto the recording medium.

Generally, as a unit for charging the surface of the photosensitive drum, a contact-type charging roller such as disclosed, for example, in U.S. Pat. No. 5,517,289 for *Apparatus for And Method Of Forming Image* issued to Ito et al., U.S. Pat. No. 5,479,243 for *Image Forming Apparatus And Charging Device Thereof* issued to Kurokawa, and U.S. Pat. No. 5,164,779 for *Image Forming Apparatus With Dual Voltage Supplies For Selectively Charging And Discharging An Image Bearing Member* issued to Araya et al., using a so-called contact (or direct) charging scheme or a corona wire using a corona discharging scheme may be used to produce an uniform electric field in response to application of high voltage for charging the surface of the photosensitive drum to a constant potential to attract toner particles and thereby form the latent image on the photosensitive drum. Typically, a charging unit is charged at the start of a printing operation. The surface of the photosensitive drum is charged and a developing unit is concurrently charged by way of the charging unit as the photosensitive drum rotates in a direction opposite to the rotation of the developing unit. As a result, an electrostatic latent image is formed on the photosensitive drum and the latent image is then visualized as a toner image by the developing unit. The charged area of the photosensitive drum is then exposed to a laser beam. Because of the potential difference between the exposed area and the unexposed area of the photosensitive drum, the toner particles are attracted only to the exposed area to form the toner image on the photosensitive drum. The toner image is then transferred to the recording medium. After the toner image is transferred to the recording medium, the photosensitive drum is charged back to an original voltage as the recording medium is being conveyed to a fixing unit. When the toner image is fixed on the recording medium by the fixing unit, the photosensitive drum is charged to a reference voltage. The residual toner on the surface of the photosensitive drum is then cleaned by a cleaning blade of a cleaning device and is collected as waste toner in an interior of the cleaning device such as disclosed in U.S. Pat. No. 5,559,593 for *Cleaning Device For An Image Forming Apparatus* issued to Yoshinaga et al.

The charging unit also need to be cleaned because its surface often becomes contaminated with fine dust particles. Cleaning techniques for such a contact-type charging unit are well known in the art such as disclosed in U.S. Pat. No. 5,506,669 for *Cleaning Device Having Potential Applying Member And Image Forming Apparatus Having Reciprocating Recording Material Carrying Member* issued to Inoue et al., U.S. Pat. No. 5,541,717 for *Cleaning Method For Contact Charging Means In Image Forming Apparatus* issued to Saito et al. More sophisticated cleaning technique for the charging unit is recently disclosed, for example, in U.S. Pat. No. 5,557,375 for *Contact Type Charging Device And Image Forming Apparatus Having The Same* issued to Nagayasu et al., in which the charging unit is positioned at a cleaning position where foreign matter adhering thereto is removed. In such an image forming apparatus, however, the positively charged toner may still remain on outer surface of the contact-type charging roller. The cleaning of such a contact-type charging roller may be enhanced by application of a voltage to the photosensitive drum during cleaning. However, it has been my observation that it is still impossible to completely clean the positively charged toner adhering to the contact-type charging roller.

SUMMARY OF THE INVENTION

Accordingly, it is therefore an object of the present invention to provide an improved image forming apparatus using an electrophotographic developing process for efficiently charging a surface of a photosensitive drum and for then cleaning residue toner from the surface of a contact-type charging roller.

It is also an object to provide a method of controlling a charge voltage of a contact-type charging roller in an image forming apparatus so as to enhance cleaning efficiency by increasing the number of collecting positively-charged toner adhering to the contact charging roller.

These and other objects of the present invention can be achieved by a method for controlling a charge voltage of an apparatus using an electrophotographic developing process which includes: applying a charge voltage of a predetermined voltage level to a contact charging unit to uniformly charge an outer surface of a photosensitive drum to a predetermined polarity while a main motor rotates; when cleaning the contact charging unit, applying a charge voltage exhibiting a voltage level lower than the predetermined voltage level to the contact charging unit to create a potential difference between the contact charging unit and the photosensitive drum; and transferring charged toner particles adhered to the contact charging unit, and to the photosensitive drum by shutting off the charge voltage being applied to the contact charging unit.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
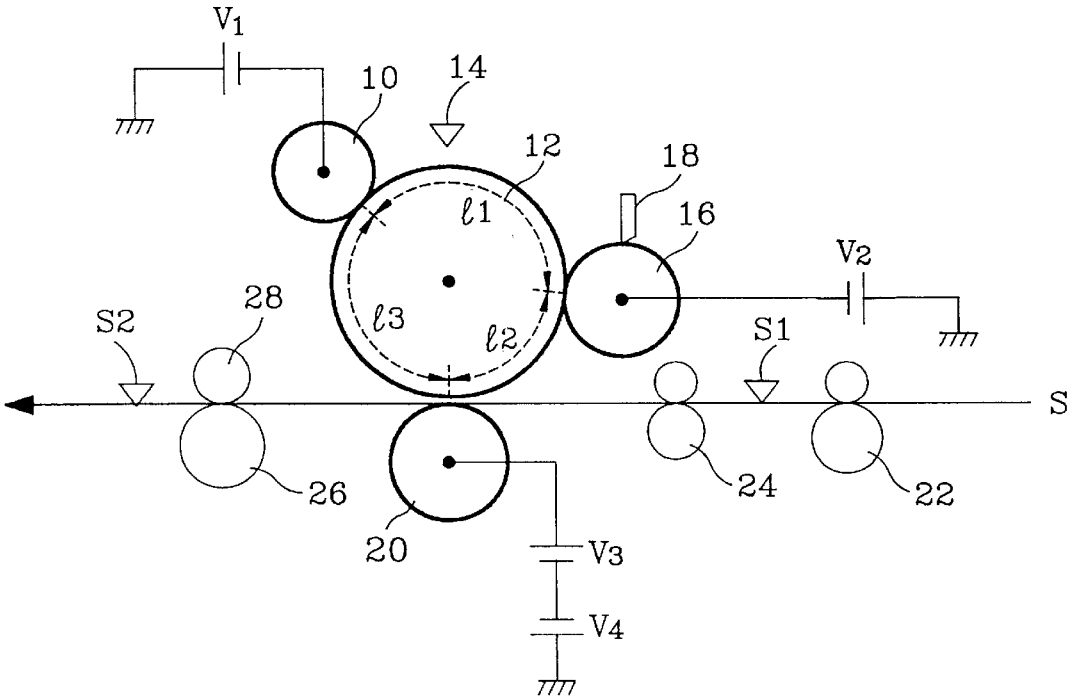
FIG. 1 illustrates a schematic engine mechanism of a laser beam printer using an electrophotographic developing process.

Referring now to the drawings and particularly to FIG. 1, which illustrates a schematic engine mechanism of a laser beam printer using an electrophotographic developing process. As shown in FIG. 1, a conductive roller 10 is used as a contact charging unit of the laser beam printer. The electrophotographic developing process requires essentially five steps of (1) charging, (2) exposing, (3) forming a toner image on a photosensitive drum 12, (4) transferring the toner image formed on the photosensitive drum 12 to a recording medium, and (5) fixing the toner image permanently on the recording medium.

The first step is charging the photosensitive drum 12 of the laser beam printer to a predetermined polarity. That is, the conductive roller 10 is charged to a negative polarity by a charge voltage V1, and the photoconductive drum 12, which is in contact with the conductive roller 10, is also charged to a negative polarity as each discrete recording medium is conveyed from a conveyance roller 22 into a registration position at a registration roller 24. The second step is exposing a portion of the photoconductive drum 12 that corresponds to an image area to a laser beam by using a light emitting diode 14 so that an electrostatic latent image is formed on a surface of the photoconductive drum 12.

The third step is transforming the electrostatic latent image formed on the outer surface of photoconductive drum 12 into a visual image. An outer surface of a developing roller 16 is uniformly charged to a negative polarity by a development voltage 2V. Accordingly, toner contained in a toner hopper is friction-charged to a negative polarity and moved to a developing area by the developing roller 16. The amount of each of the toner and carrier is controlled by a doctor blade 18, and the positively charged toner is moved to the developing area. The positively charged toner is abnormal toner. Toner particles, which is moved to the developing area, are carried to the exposed portion of the photoconductive drum 12 by ambient electric field so that the latent image is visualized as a toner image.

The fourth step is transferring the toner image formed on a surface of the photosensitive drum 12 onto a recording medium. Positive charges generated by a transfer voltage V3 from a transfer roller 20 serve to attract the positively charged toner particles from the photosensitive drum 12 to be transferred onto the recording medium S as the recording medium S passes through the transfer roller 20. The fifth step is permanently fixing the toner image formed on the recording by a pressure roller 26 and a heat roller 28, after which the recording medium S is discharged through an output tray.

A first sensor S1 located in a paper path between the conveyance roller 22 and the register roller 24 monitors the state of the recording medium that is conveyed to the registration position at the register roller 24. A second sensor S2 located in a paper output path next to the fixing rollers 26 and 28, monitors the state of the recording medium output to a top output tray (not shown). The toner adhering to the photoconductive drum 12 is transferred to the recording medium S during transferring step, and a small amount of the positively charged toner or the toner that has not been cleaned yet may still remain on the photoconductive drum 12 in such a manner that the positively charged toner accumulates on the outer surface of the conductive roller 10. As a result, the charge voltage V1 of the conductive roller 10 becomes lower than the initial charge voltage.

The control sequence of the charge voltage for cleaning the toner remaining on the conductive roller 10 will now be described with reference to FIGS. 2A–2C which illustrate a timing diagram of different voltages applied to the conductive roller 10, the developing roller 16, and the transfer roller 20 in the laser beam printer as shown in FIG. 1.

Figures 2A, 2B, 2C:
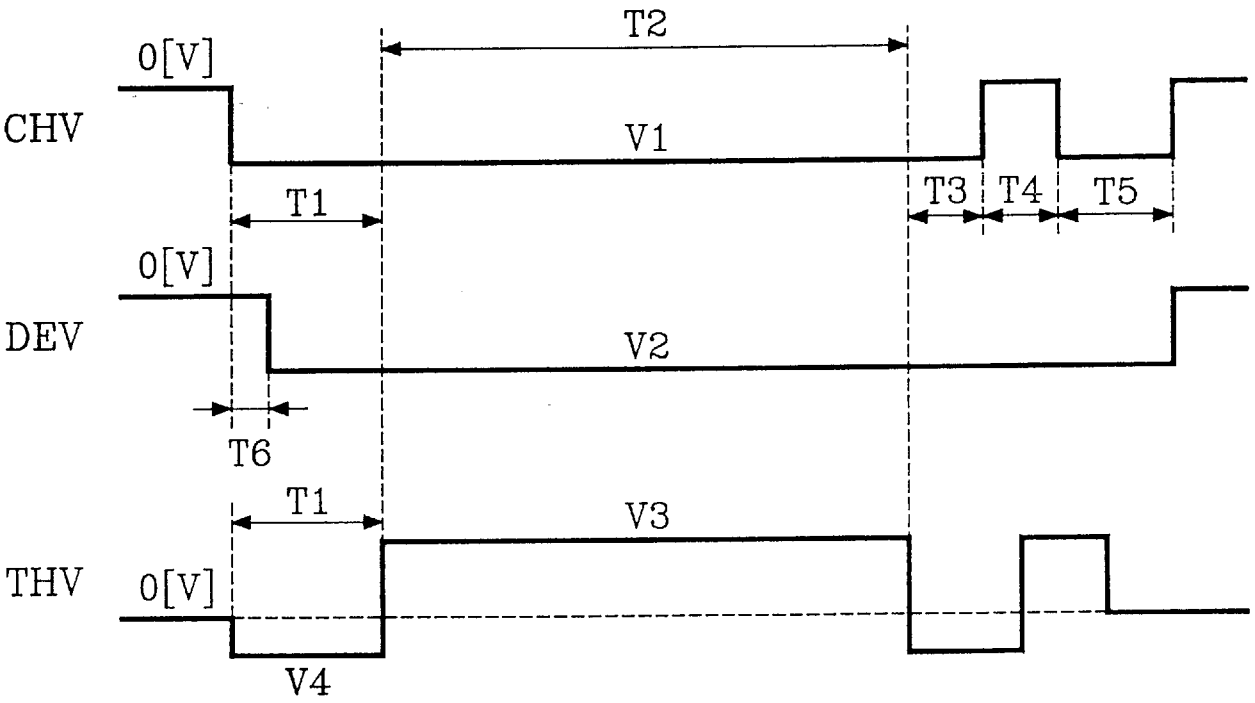
FIGS. 2A–2C are a timing diagram of voltages applied to a charge roller, a developing roller, and a transfer roller in a laser beam printer using the electrophotographic developing process.

FIG. 2A illustrates a timing diagram of a charge voltage CHV applied to the conductive roller 10, in which V1 corresponds to a voltage level of the charge voltage CHV. FIG. 2B illustrates a timing diagram of a development voltage DEV applied to the developing roller 16, in which V2 corresponds to a voltage level of the development voltage DEV. FIG. 2C illustrates a timing diagram of a transfer voltage THV applied to the transfer roller 20, in which V3 and V4 each correspond to voltage levels of the transfer voltage THV. The charge voltage CHV is constantly applied to the conductive roller 10 while a main motor of a driving system rotates. Referring to FIGS. 2A–2C, a first interval T1 represents a time period in which the photosensitive drum 12 has not yet exposed to light, and a second interval T2 represents a printing time period.

During the second interval T2, the transfer voltage THV becomes +V3, and the toner image formed on a surface of the photosensitive drum 12 is transferred on the recording medium. The charge voltage CHV becomes V1 during a third interval T3 and a fifth interval T5. The positively charged toner adhering to the outer surface of the conductive roller 10 is transferred to the surface of the photosensitive drum 12 during a fourth interval T4 where the charge voltage CHV is 0 volt. That is because the outer surface of the photoconductive drum 12 is charged to a negative polarity by V1 of negative level. The positively charged toner, moved to the photoconductive drum 12, is collected from the negatively charged developing roller 16.

A sixth interval T6 of the development voltage DEV applied to developing roller 16 represents a time period for which the photoconductive drum 12 rotates by l1 as shown in FIG. 1. During the first interval T1, the amount of the toner used for a toner image formed on the photosensitive drum 12 from the developing roller 16 is to be minimized. A voltage of −V4 is applied to the transfer roller 20 during T1 of the transfer voltage THV applied to the transfer roller 20 so as to return the toner, attached to the transfer roller 20, to the photoconductive drum 12. After printing period T2, in case that −V1, being applied to the conductive roller 10, drops to zero, there is little potential difference between photoconductive drum 12 and the conductive roller 10, and the amount of the positively-charged toner that is transferred to the photoconductive drum 12 becomes reduced. However, as I have noted that it is impossible to completely clean the positively charged toner adhering to the conductive roller 10.

Figure 3:
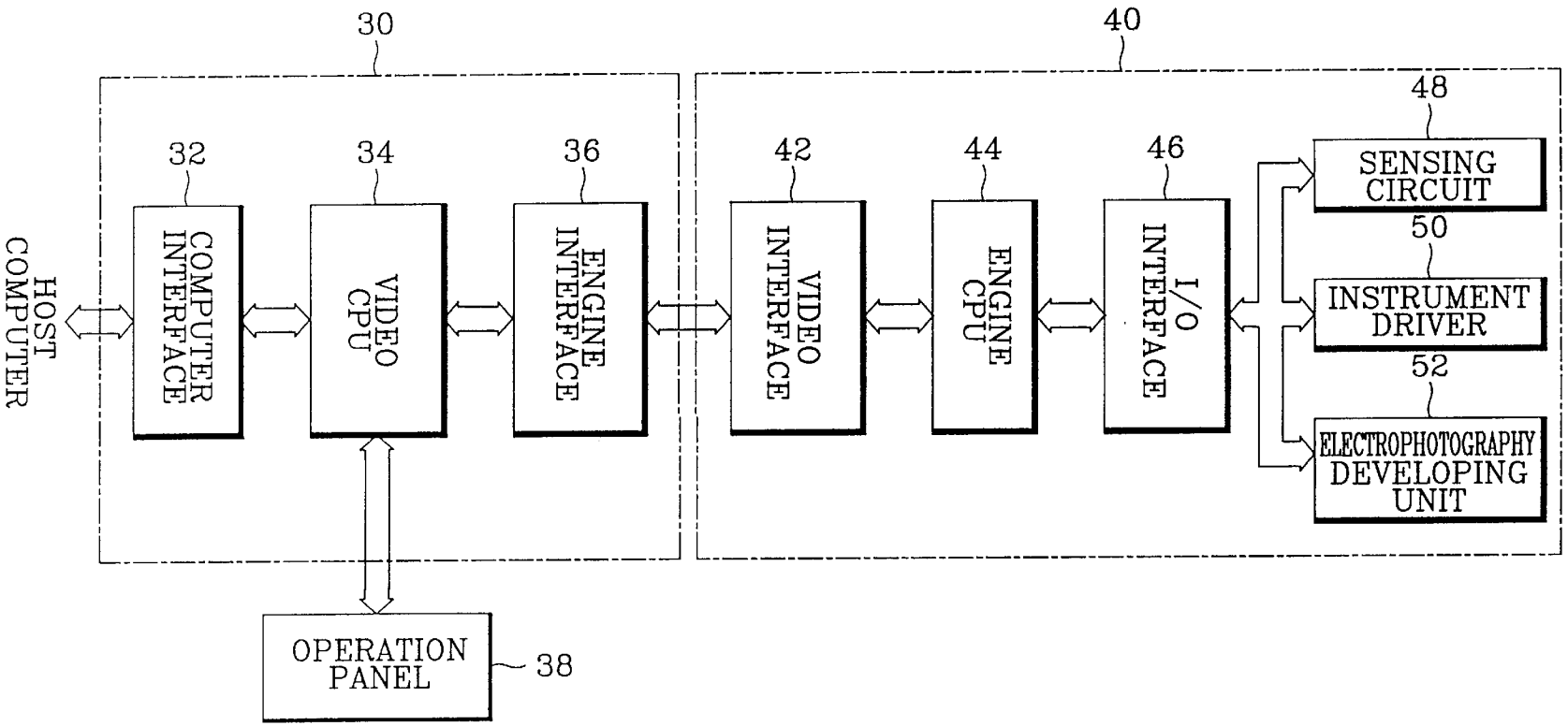
FIG. 3 is a block diagram of a laser beam printer using the electrophotographic developing process.

Turning now to FIG. 3 which is a block diagram of a laser beam printer using an electrophotographic process according to the principles of the present invention. The laser beam printer includes a video control unit 30, a print engine unit 40, and an operation panel OPE 38. Video control unit 30 includes a computer interface 32, a video central processing unit 34, and an engine interface 36. Computer interface 32 is connected between a host computer and video central processing unit 34 for transferring input/output signals.

Video control unit 30 converts data from computer interface 32 into image data so that the same image data can be processed by printer engine unit 40. Video central processing unit (CPU) 34 includes a read-only-memory (ROM) containing a control program according to the principles of the present invention, and a random-access-memory (RAM) for temporarily storing various data produced by the host computer and OPE 38. Video CPU 34 converts input data received by computer interface 32 into image data which can be processed by printer engine unit 40 according to the operating program, and then sends the converted image data to the printer engine unit 40.

Engine interface 36, which is connected between video CPU 34 and printer engine unit 40, transfers input/output (I/O) signals to and from printer engine unit 50 under the control of the video CPU 34. The OPE 38 is equipped with a set of input keys such as a charge cleaning key for allowing the user to request cleaning of the conductive roller 10, through which control commands that are sent to the printer, and a display unit for providing a visual display of status information during the printing operation, and cleaning operation.

Printer engine unit 40 includes a video interface 42, an engine central processing unit (CPU) 44, an input/output (I/O) interface 46, a sensor circuit 48, an instrument driver 50, and a developing unit 52, and is connected to video control unit 30. Video interface 42 links video control unit 30 with engine CPU 44. Under the control of image processing unit 44, engine CPU 44 has control over the instrument driver 50 and developing unit 52, and prints images corresponding to the image data from video control unit 30.

The engine CPU 44 monitors for operating failures which occur in the printer engine unit 40 such as paper feeding, paper conveyance, etc. with the sensing circuit 48. The I/O interface 46 is connected between the engine CPU 44, the sensing circuit 48, the instrument driver 50, and the developing unit 52 in order to link the engine CPU 44 with the sensing circuit 48, the instrument driver 50 and the developing unit 52. The sensing circuit 48 controls sensors which monitor the operating state of each of the components, the paper conveyance state, and the amount of toner, and transmits output signals of the sensors to engine CPU 44. The instrument driver 50 actuates various operating components of the laser beam printer used for paper feeding, paper conveyance, and printing operation. Developing unit 52 prints images under the control of engine CPU 44.

Figure 4:
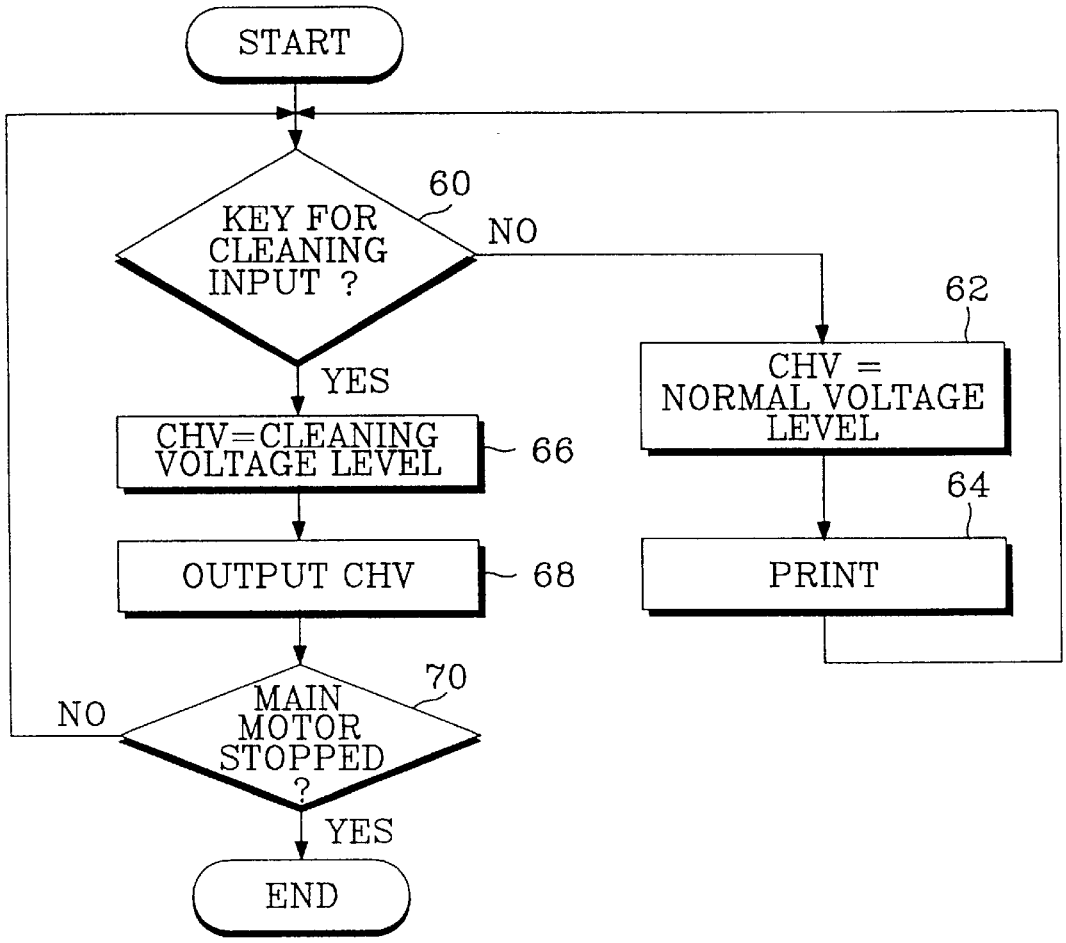
FIG. 4 is a flow diagram of a video controller for controlling a charge voltage in accordance with the principles of the present invention.
Figures 5A, 5B, 5C:
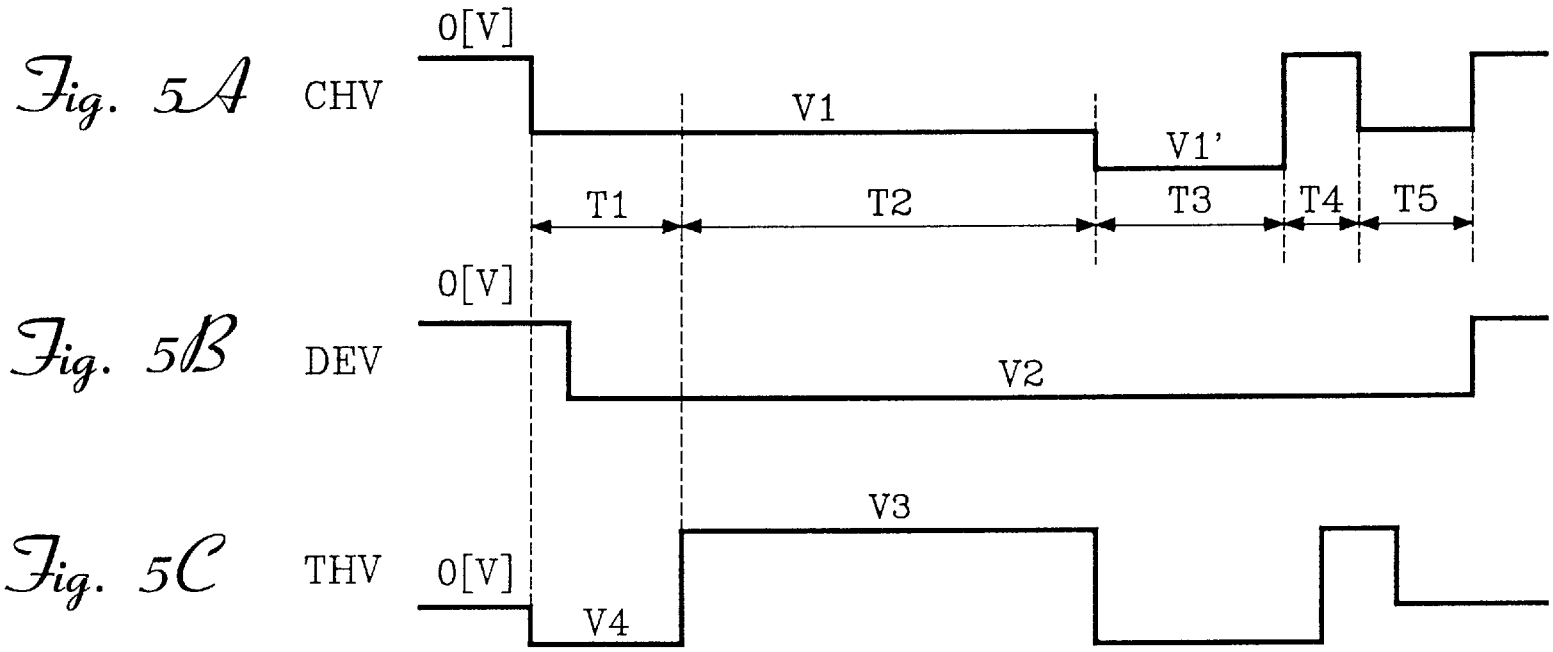
FIGS. 5A–5C are a timing diagram of application of voltages in accordance with the principles of the present invention.

FIG. 4 is a flow chart of the control sequence of the video CPU 34, and FIGS. 5A–5C are a timing diagram of application of voltages according to the principles of the present invention.

A process of cleaning positively charged toner adhering to the conductive roller 10 will now be described with reference to FIGS. 1, 4 and 5A–5C. This cleaning process may be performed either when a warm-up of a laser beam printer using an electrophotographic developing process is carried out upon power activation of the printer, or when there is a key board input for cleaning. In addition, the printer may go into cleaning operation at any time if the printer's main motor does not stop after the printing operation has been completed.

In a preferred embodiment of the present invention, a process of cleaning positively charged toner that is adhering to the conductive roller 10 in response to a key input for cleaning, will be described as follows.

Referring first to FIG. 4, video CPU 34 that is in standby mode determines, at step 60, whether there is a key input for cleaning the conductive roller 10 from OPE 38. If a command to print is input from a host computer without any key input for cleaning, the video CPU 34 sets the charge voltage CHV to a normal voltage level, and proceeds to step 64. The video CPU 34 prints at step 60 video image corresponding to the image information that is input from the host computer, and returns to step 60. When a key input requesting cleaning of the conductive roller 10 is input from the OPE 38, the video CPU 34 sets the charge voltage CHV at step 66, applied to the conductive roller 10, to a cleaning level. Once a command to print is input from the host computer, the video CPU 34 outputs the preset CHV to perform the printing and cleaning operation at step 68, simultaneously.

Referring to FIG. 5, once a command to print is input from the host computer, the video CPU 34 controls the electrophotographic developing unit 52 to apply CHV, DEV and THV to the conductive roller 10, the developing roller 16, and the transfer roller 20, respectively. The time intervals T1, T2, T4 and T5 and voltage levels V1 to V4 are similar to those described in FIGS. 2A–2C, and there is a difference in V1' that is applied to the conductive roller 10 after the second interval T2. V1' of CHV applied to the conductive roller during the third interval T3 has a negative value lower than V1's, so as to increase the amount of the positively charged toner by making large a potential difference of the photoconductive drum 12 and the conductive roller 10 during the fourth interval T4 wherein the charge voltage CHV, being applied to the conductive roller 10, drops to zero. Once the cleaning operation is completed through the above control sequence, the video CPU 34 checks at step 70 if the main motor stops. If the video CPU 34 determines that the main motor continues to rotate, the printing and cleaning operation is repeatedly carried out. When the main motor stops, the cleaning process is completed.

As described above, the present invention easily and advantageously collects the positively charged toner from the contact-type charging roller by applying to the contact-type charging roller a voltage of negative level lower than the charge voltage, applied during the printing operation, before shutting off the charge voltage, during warm-up, prior to stopping the main motor, or in response to a key input. A method of controlling a charge voltage of the contact-type charger roller according to the principles of the present invention is readily applicable to all image forming apparatus using an electrophotographic developing process and having a contact-type charging roller.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof Therefore, it is intended that the present invention not be limited to the particular embodiment disclosed as the best mode contemplated for carrying out the present invention, but that the present invention includes all embodiments falling within the scope of the appended claims.

What is claimed is:

1. A method for controlling a charge voltage of an image forming apparatus using an electrophotographic developing process, comprising the steps of:

applying a charge voltage of a predetermined voltage level to a contact charging unit to uniformly charge an outer surface of a photoconductive body to a predetermined polarity while a main motor of said image forming apparatus rotates;

when cleaning said contact charging unit, applying a charge voltage exhibiting a voltage level lower than said predetermined voltage level to said contact charging unit to increase a potential difference between said contact charging unit and said photoconductive body; and transferring charged toner particles adhered to said contact charging unit to said photoconductive body by shutting off said charge voltage being applied to said contact charging unit.

2. The method of claim 1, further comprised of said applying a charge voltage of a predetermined voltage level to said contact charging unit to uniformly charge the outer surface of said photoconductive body during a warm-up operation of said image forming apparatus.

3. The method of claim 2, further comprised of said transferring charged toner particles adhered to said contact charging unit to said photoconductive body during a warm-up operation of said image forming apparatus.

4. The method of claim 1, further comprised of said applying a charge voltage of a predetermined voltage level to said contact charging unit to uniformly charge the outer surface of said photoconductive body, when there is a key input requesting cleaning the positively charged toner adhered to said contact charging unit from an operational panel of said image forming apparatus.

5. The method of claim 4, further comprised of said transferring charged toner particles adhered to said contact charging unit to said photoconductive body, when there is a key input requesting cleaning of said contact charging unit from an operational panel of said image forming apparatus.

6. The method of claim 1, further comprised of said applying a charge voltage of a predetermined voltage level to said contact charging unit to uniformly charge the outer surface of said photoconductive body before said main motor stops after completion of a printing operation.

7. The method of claim 6, further comprised of said transferring charged toner particles adhered to said contact charging unit to said photoconductive body before said main motor stops after completion of a printing operation.

8. An image forming apparatus, comprising:

a photosensitive drum;

a contact-type charging roller positioned in contact with the photosensitive drum to uniformly charge a surface of the photosensitive drum during charging operation;

exposing means for exposing the surface of the photosensitive drum charged by said contact-type charging roller;

developing means for developing a latent image electrostatically formed on the photosensitive drum by said exposing means to produce a visible image;

transferring means for transferring the visible image to a recording medium;

fixing means for fixing the visible image transferred to the recording medium; and a power source electrically connected to said contact-type charging roller, for applying a first charge voltage to said contact-type charging roller to control the charging of the surface of the photosensitive drum during said charging operation, and for applying a second charge voltage lower than said first charge voltage to increase a potential difference between said contact-type charging roller and said photosensitive drum upon initiation of a cleaning operation, and for transferring charged toner particles adhered to said contact-type charging roller to said photosensitive drum during said cleaning operation when said second charge voltage as applied to said contact-type charging roller is shut off from said contact-type charging roller.

9. The image forming apparatus of claim 8, further comprised of said power source applying the first charge voltage to said contact-type charging roller to uniformly charge the surface of said photosensitive drum during a warm-up operation of said image forming apparatus.

10. The image forming apparatus of claim 8, further comprised of said power source enabling transferring of the charged toner particles adhered to said contact-type charging roller to said photosensitive drum during a warm-up operation of said image forming apparatus.

11. The image forming apparatus of claim 8, further comprised of said power source applying the first charge voltage to said contact-type charging roller to uniformly charge the surface of said photosensitive drum, when there is a key input requesting cleaning of said contact-type charging roller from an operational panel of said image forming apparatus.

12. The image forming apparatus of claim 8, further comprised of said power source enabling transferring of the charged toner particles adhered to said contact-type charging roller to said photosensitive drum, when there is a key input requesting cleaning of said contact-type charging roller from an operational panel of said image forming apparatus.

13. The image forming apparatus of claim 12, further comprised of said power source applying the first charge voltage to said contact-type charging roller to uniformly charge the surface of said photosensitive drum before a main motor stops after completion of a printing operation.

14. The image forming apparatus of claim 13, further comprised of said power source enabling transferring of the charged toner particles adhered to said contact-type charging roller to said photosensitive drum body before said main motor stops after completion of said printing operation.

15. An image forming apparatus, comprising:

a photosensitive drum;

a contact-type charging roller positioned to contact with the photosensitive drum to uniformly charge a surface of the photosensitive drum during a charging operation;

exposing means for exposing the surface of the photosensitive drum charged by said contact-type charging roller;

a developing roller for developing a latent image electrostatically formed on the photosensitive drum by said exposing means to produce a visible image; and a power source electrically connected to said contact-type charging roller, for applying a first charge voltage to said contact-type charging roller to charge the surface of the photosensitive drum during said charging operation, and subsequently, for applying a second charge voltage lower than said first charge voltage to said contact-type charging roller to increase a potential difference between said contact-type charging roller and said photosensitive drum upon initiation of a cleaning operation, and cutting off application of said second charge voltage to said contact-type charging roller to transfer charged toner particles adhered to said contact-type charging roller to said photosensitive drum during said cleaning operation; and said developing roller collecting the charged toner particles which were transferred to said photosensitive drum during said cleaning operation, upon completion of said cleaning operation.

16. The image forming apparatus of claim 15, further comprised of said power source applying the first charge voltage to said contact-type charging roller to uniformly charge the surface of said photosensitive drum during a warm-up operation of said image forming apparatus.

17. The image forming apparatus of claim 15, further comprised of said power source applying the first charge voltage to said contact-type charging roller to uniformly charge the surface of said photosensitive drum, when there is a key input requesting cleaning of said contact-type charging roller from an operational panel of said image forming apparatus.

18. The image forming apparatus of claim 15, further comprised of said power source applying the first charge voltage to said contact-type charging roller to uniformly charge the surface of said photosensitive drum before a main motor stops after completion of a printing operation.

* * * * *